US008978752B2

(12) United States Patent
Dobson et al.

(10) Patent No.: US 8,978,752 B2
(45) Date of Patent: Mar. 17, 2015

(54) ELECTRIC SUBMERSIBLE PUMP BAND BASKET CATCHER

(75) Inventors: Ronald E. Dobson, Cypress, CA (US); Gary J. Erickson, Huntington Beach, CA (US)

(73) Assignee: Central Fishing Tool, Inc., Signal Hill, CA (US)

( * ) Notice: Subject to any disclaimer, the term of this patent is extended or adjusted under 35 U.S.C. 154(b) by 31 days.

(21) Appl. No.: 13/042,427

(22) Filed: Mar. 7, 2011

(65) Prior Publication Data

US 2012/0024522 A1 Feb. 2, 2012

Related U.S. Application Data

(60) Provisional application No. 61/313,425, filed on Mar. 12, 2010.

(51) Int. Cl.

| | |
|---|---|
| ***E21B 31/08*** | (2006.01) |
| ***E21B 17/02*** | (2006.01) |
| ***E21B 27/00*** | (2006.01) |
| ***E21B 43/12*** | (2006.01) |

(52) U.S. Cl.

CPC ..... *E21B 17/026* (2013.01); *E21B 27/00* (2013.01); *E21B 43/128* (2013.01)

USPC ..... 166/99

(58) Field of Classification Search

USPC ..... 166/99, 177.4; 277/335

See application file for complete search history.

(56) References Cited

U.S. PATENT DOCUMENTS

| | | | | |
|---|---|---|---|---|
| 1,880,004 | A * | 9/1932 | Worswick | 166/99 |
| 3,385,368 | A * | 5/1968 | Solum et al. | 277/335 |
| 5,180,014 | A * | 1/1993 | Cox | 166/384 |

* cited by examiner

*Primary Examiner* — Giovanna Wright

(57) ABSTRACT

A basket catcher for catching debris such as broken metal bands from an oil borehole casing as production tubing is withdrawn. The basket catcher has a collar that includes a series of spring-tensioned blades directed upwardly catch debris as the basket is withdrawn through the casing, preventing the debris from occluding the borehole.

20 Claims, 7 Drawing Sheets

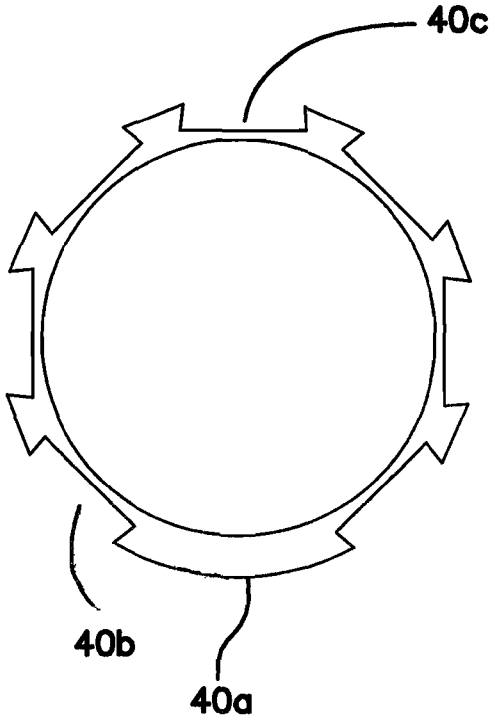
FIG. 4
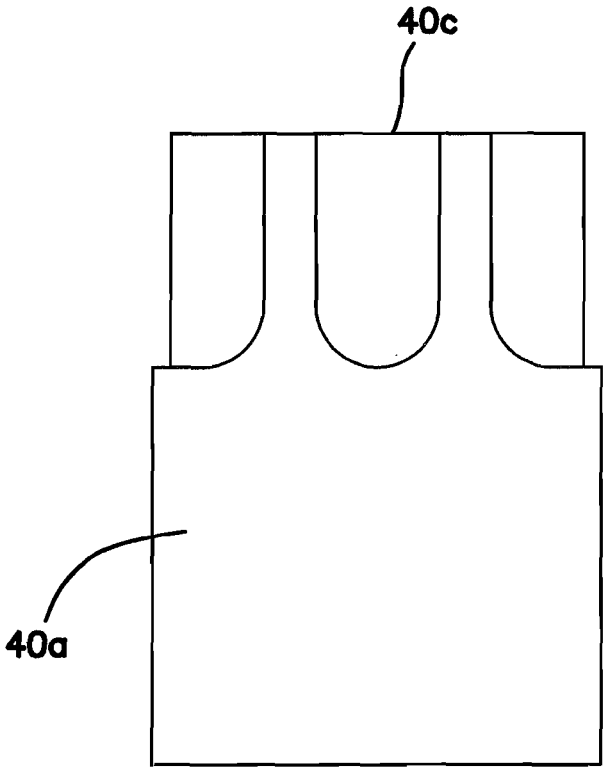

ELECTRIC SUBMERSIBLE PUMP BAND BASKET CATCHER

RELATED APPLICATIONS

This application hereby claims the priority filing date of and incorporates by reference U.S. provisional patent application 61/313,425, filed Mar. 12, 2010, entitled Electric Submersible Pump Band Basket Catcher, inventors Gary Erickson and Ronald Dobson.

COPYRIGHT NOTICE

A portion of the disclosure of this patent document contains material which is subject to copyright protection. The copyright owner has no objection to the facsimile reproduction by anyone of the patent document or the patent disclosure as it appears in the Patent and Trademark Office patent file or records, but otherwise reserves all copyright rights whatsoever.

FIELD OF THE INVENTION

This invention relates to petroleum extraction and more particularly to a method and apparatus for clearing the borehole of an oil well bore.

BACKGROUND OF THE INVENTION

Referring now to the figures, in many environments crude oil is produced by boring a shaft or borehole 10 into the ground down to a natural reservoir of oil 11 and then inserting a pump into the borehole and pumping the oil out of that reservoir.

The borehole 10 is drilled and then lined with a tubular metal casing 12. The casing 12 is made up of lengths of casing pipe coupled together to form one continuous pipe with a central bore. Each length of casing is in the range of about forty-four feet long and has male threads at both ends, joined together with female-female threaded collars 16 to form the continuous tube with an interior bore. A collar 16 generally is a short length of pipe with female threads on either end that acts as a coupling to join two lengths of pipe, here casing 12 pipe having male threads at each end. When the male threads of two casing pipes are inserted into a collar there is a short gap within the collar between the ends of adjoining lengths of casing pipe.

Oil reservoirs 11 may be relatively deep, perhaps 6,500-11,000 feet deep, and the borehole may need to be drilled through several zones of different material found at lesser depths, such as an aquifer that might be found at a relatively shallow 1,500 feet or less below the surface. In addition to the casing 12 of the borehole 10, cement may be poured around the outside of the casing to seal the walls of the borehole from the surrounding material. This seal is created both to prevent oil leakage out of the borehole and fluid leakage into the borehole from the various surrounding zones of material. This seal may be critical in order to prevent the oil from leaking out of the borehole and contaminating a surrounding aquifer that the borehole passes through.

At the terminal or bottom end of the casing 12, where the borehole 10 intrudes into an oil reservoir or oil sands zone 11, a final section of liner 14 pipe is placed and hung with liner hanger to the end of the casing, forming a single continuous bore through the casing and liner pipe.

A joint 18 refers generally to a single length of pipe, for example liner, casing, or tubing that has threaded connections at both ends. Joints 18 are made in standard lengths depending on the type of pipe. Several joints 18 coupled together are called a stand of pipe and a string of pipe refers to the entire length of all the joints of pipe or tube used in the length of the borehole. A pup joint 20 is a joint of less than standard length. The shorter lengths of pup joint production tubing are used to adjust the total length of a stand or string should the desired length be less than exactly a multiple of the standard lengths, to add a length of pipe of less than a whole standard length to more precisely size the total length of the string.

Typically the liner 14 pipe used has a narrower internal diameter than that of the casing pipe it is used with, for example a typical industry standard uses a casing 12 having an internal diameter of 8⅝ inch and is used with a liner pipe having a narrower 6⅝ inch internal diameter. The liner 14 pipe is also different from the casing 12 in that the liner is not sealed from the surrounding material and is instead perforated with voids or slots 14A. The liner 14 is inserted into an oil reservoir or oil sands zone 11 and allows oil from the reservoir or reservoir sands 11 to seep through the perforations 14A into the liner. The voids 14A of the liner 14 may be slots that are small enough to keep most surrounding sand out of the liner while allowing the crude oil to seep into the liner.

An electric submersible pump 22 comprised of various components including an impeller and electric motor is lowered into the casing and is hung atop the opening of the liner 14 pipe. The electric motor portion of the pump 23 is usually located at the bottom of the submersible pump 22 and is sized to fit within the casing 12.

The electric pump 22 has couplings or flanges at each end to allow several pumps to be connected in series as a single pump and the pump sucks liquid that's entered from the liner 14 section at the lower end, the intake opening 22A and expels it through the second upper opening at the top of the pump, the exhaust opening 22B, at the opposite end of the pump. Production tubing or line 24 is affixed to the exhaust opening 22B to achieve liquid communication with the pump. The production tubing 24 connected to the pump 22 runs from the pump to the surface within the length of the casing 12. The electric pump 22 and production tubing 24 together form a single liquid conduit through which oil is pumped from the liner 14 through the production tubing to the surface.

The motor 23 of the electric pump 22 is sized to fit snugly within the casing and therefore has an outside diameter larger than that of the liner 14 section, preventing the electric pump motor from entering the liner section. In cases where the diameter of the pump motor may be less that of the liner, the pump may include a No-Go 26, which are flanges or protuberances or wings 26A affixed to and protruding from the electric pump or other tools that are lowered into the casing. The No-Go 26 functions to maintain a sufficient outside diameter so as to interfere with the internal diameter of the liner pipe 14 section, thereby preventing that pump or tool from entering the liner section.

The production tubing 24 is usually of substantially smaller outside diameter than the casing 12 internal diameter that it is placed in. In the example used the production tubing 24 may have an outside diameter of 2⅞ inches. As with the casing pipe 12, each joint of the production tubing 24, including pup joints 20, has two male ends. A collar 16 is used to connect two joints together to form a stand or string of production tubing 24. Production tubing 24 joints are joined together with production tubing collars 16 to form a string of production tubing connected to the electric pump 22 and traversing the length of the casing.

The electric pump motor 23 requires an electric power supply to operate and therefore an electric cable 28 of about 1¼ inches in diameter is plugged into the pump motor 23. Flat cable is plugged into the pump directly, runs up the productions line 24 for a joint or two, then the 1¼ cable is used, which runs the length of the production tubing to a power source located on the surface. Metal bands 30 are installed around the production tubing 24 and electric cable 30 at intervals to hold them together to prevent the electrical cable from becoming entwined, jammed or knotted up when the production tube is inserted or withdrawn from the casing 12. The bands 30 are typically metal strapping affixed around the electric cable and crimped together with a saddle fastener (not shown). The pump uses a flat special banding, flat guards banding to band the flat cable to the pump.

The bands 30 are affixed around the production tubing 24 and electrical cable 28, and, around the electric pump 22 and electric cable 28 as the stand of pipe is assembled and lowered into the casing 12. The bands 30 are typically placed on either side of the production tubing collars 24A as joints are added. A count is kept of the number of bands affixed to the production tubing determine how many may be missing when the string is eventually removed from the casing 12.

A problem arises as the string of production tubing 24 and pump 22 is withdrawn from the casing, for example to service the electric pump. The bands 30 may rub against the interior wall of the casing 12 or snag on the gaps in the casing collars and then the bands sometimes break and fall off into the casing. The broken bands 30 may occlude the casing 12, jamming the casing and making it difficult to reinsert the electric pump 22 and string of production tubing 24 for example.

This band debris problem is especially acute in a deviated drill borehole where the borehole was drilled with a deviation from vertical. Many or most modern oil well boreholes are not vertical shafts, they bend at several junctures and some run horizontally for great distances. The act of withdrawing the pump from a casing that is not oriented vertically exacerbates the damage to the bands because the weight of the production tubing make it more likely that the bands will rub against or be dragged along the interior of the casing, breaking the bands.

This problem is addressed by clean-out procedures. The number of bands 30 affixed to a production tubing 24 string are counted when the production tubing is inserted and, should there be bands missing after the production tube string is withdrawn from the casing 12, the casing must be cleaned out. The broken bands usually have to be extracted from the casing before the pump can be again placed in the casing. The present methods of cleaning out an oil well casing of broken bands and other debris are expensive, laborious and very time-consuming, keeping the oil well out production during the cleanout procedure.

If there are bands missing from those counted after the production line is withdrawn a two-stage cleanout operation typically is performed. In the first stage of the cleanout operation a surge tool 32 is inserted down the length of the bore. A surge tool 32 has a rubber packoff cup 32A that is sized to snugly fit within the inside diameter of the casing 12 to form a seal. The surge tool 32 has a central opening with a junk catcher 34 mounted within the central opening to create a one-way trap for debris to pass through as the surge tool is inserted. The junk catcher includes a radial array of fingers 34A that are spring-biased to bend into the surge tool only, to allow debris to pass into the body of the surge tool, then snap closed to retain the debris. The surge tool 32 is affixed to a length of perforated pup joint 32B at the end opposite the junk catcher and the pup joint is also attached to the production tubing string. As the surge tool 32 is inserted into the casing 12 most liquid and debris in the casing will be forced through and be trapped by the junk catcher 34 within the surge tool. As the surge tool is withdrawn the pup joint perforations allow liquid to still pass even when the debris trapped by the junk catcher clogs the bottom of the surge tool.

The surge tool 32 is lowered into the casing the entire length by affixing successive lengths of production tubing 24, then withdrawn. The debris and broken bands are thereby trapped within the surge tool 32 as it is inserted and are collected for disposal as the surge tool is pulled to the surface.

This first surge tool operation is time consuming and may take four to six hours to complete.

After the surge tool operation has been completed a second cleanup operation is conducted to pulverize any remaining contaminants, bands or other debris still in the casing and missed by the surge tool operation. In the second stage of the cleanout operation a grinding head 36 is inserted down the length of the bore. Like the surge tool 32 the grinding head 36 also has a central opening with a junk catcher 34 mounted within the central opening to create a one-way gate for debris to pass through as the surge tool is inserted. The outer edge of the grinding head 36 surrounding the junk catcher 24 is comprised of a rough material made of a hard metal such as tungsten-carbide. The grinding tool is affixed to production tubing 24 and lowered the length of the casing 12. As the grinding head 36 encounters debris or broken bands it grinds them up and the ground-up debris is forced through the junk catcher 34, to be withdrawn later with the grinding head for disposal. This second separate operation is also time-consuming and may take another four to six hours or longer to complete.

What is needed then is a device and method for more easily and reliably removing any broken bands, reducing the need for these cleanup operations.

BRIEF DESCRIPTION OF THE DRAWINGS

FIG. 4 is a top and side schematic view of the collar fabrication details of the basket catcher of the present invention.

SUMMARY OF THE INVENTION

Figure 1:
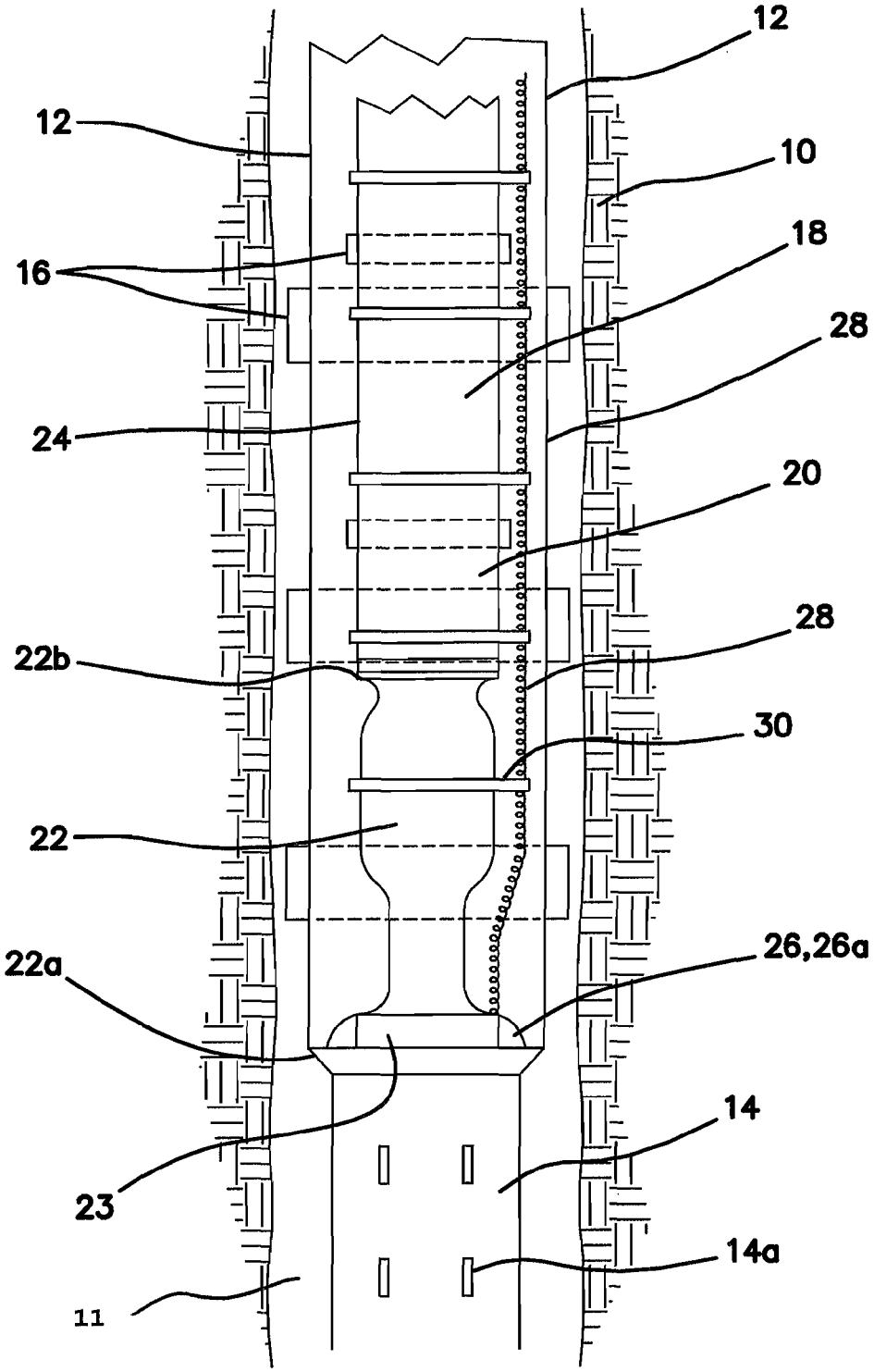
FIG. 1 PRIOR ART
FIG. 1 is a cross-section diagram of the components of an oil well bore.
Figure 2:
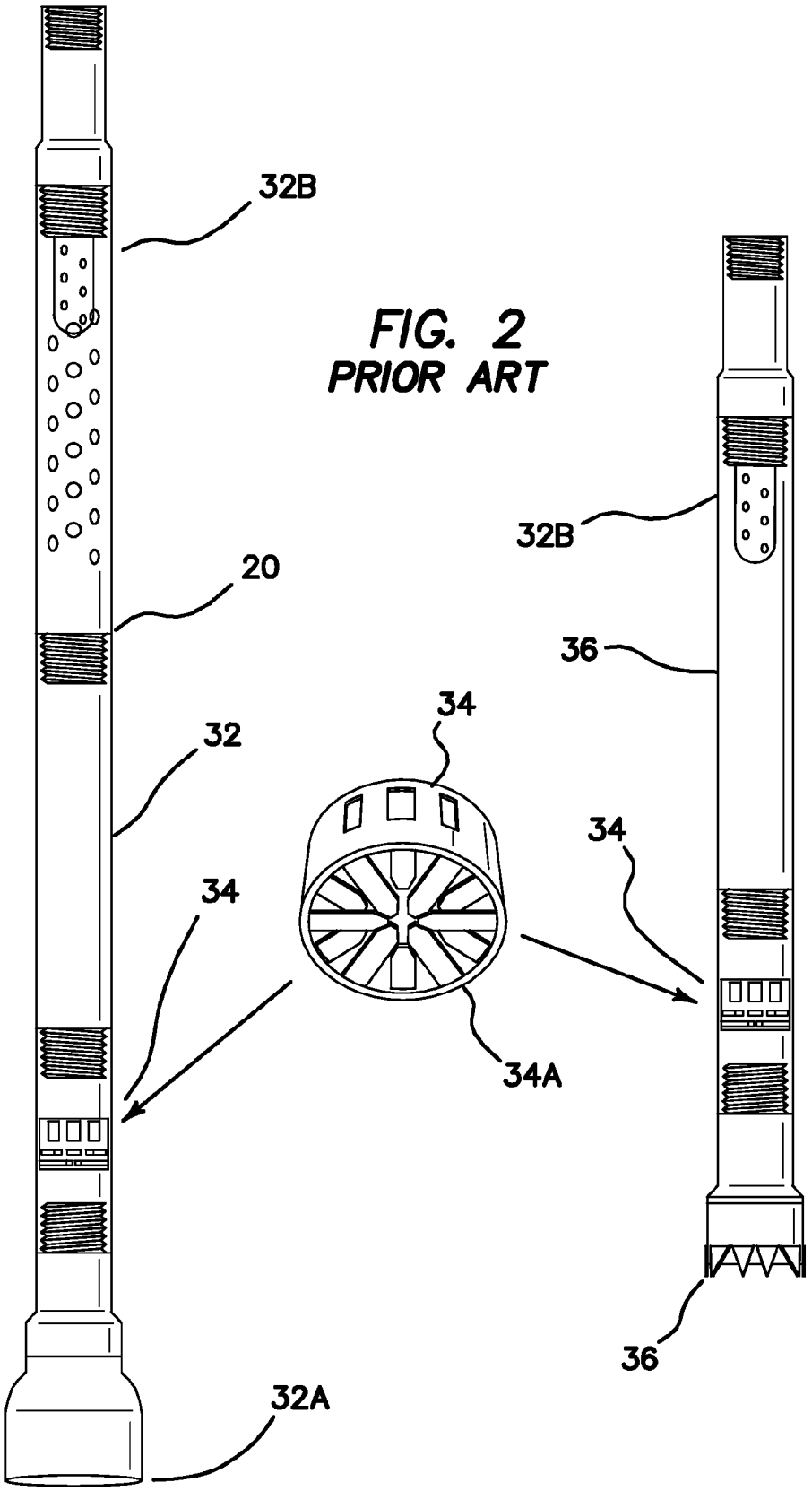
FIG. 2 PRIOR ART
FIG. 2 is a cross-section diagram of the components of tools of the prior art used to clean out the casing of an oil well.
Figure 3:
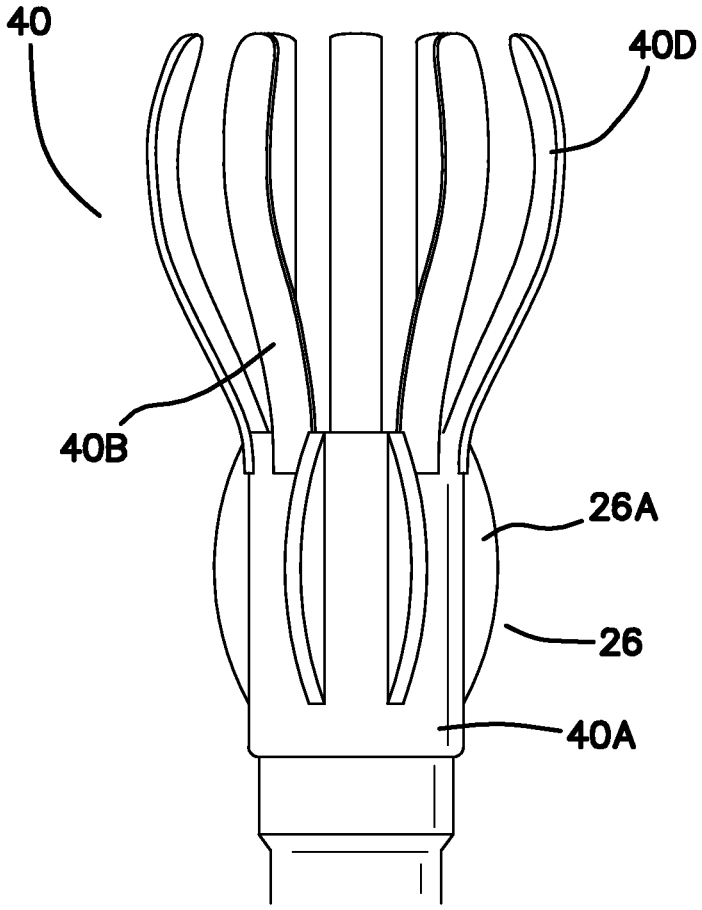
FIG. 3 is a perspective view of the basket catcher of the present invention.
Figure 5:
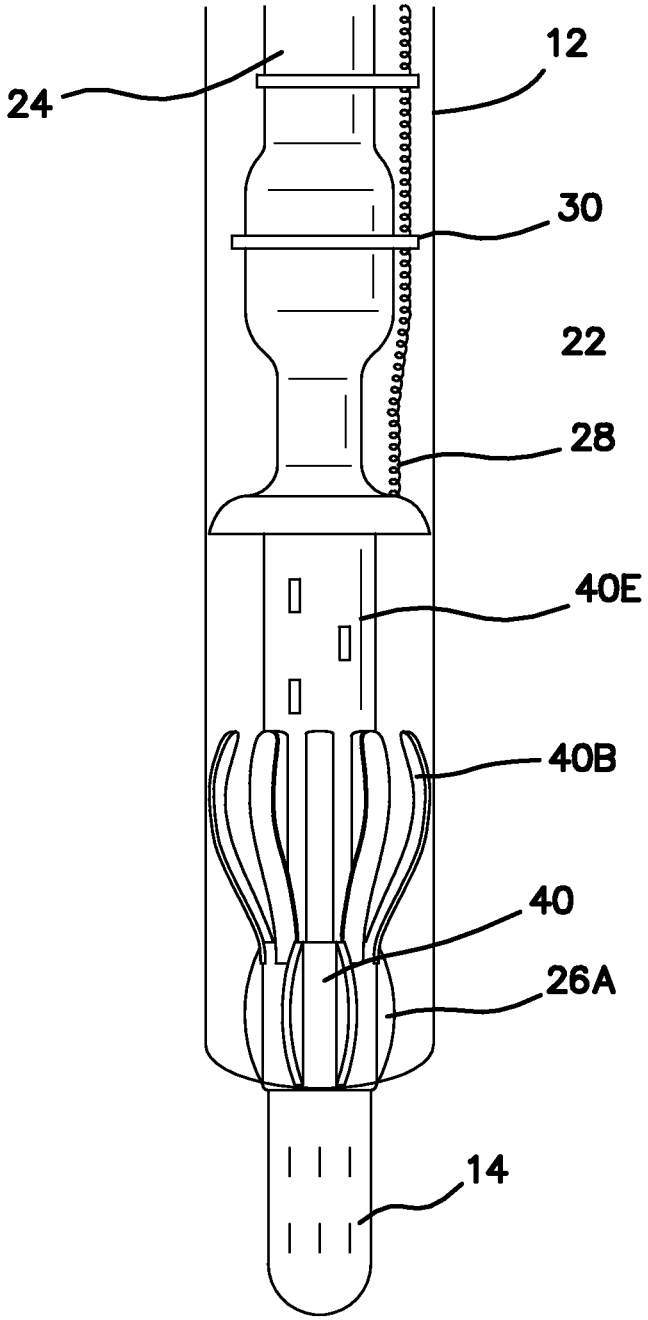
FIG. 5 a cross-section diagram of the present invention in use with components of the prior art in one configuration.
Figure 6:
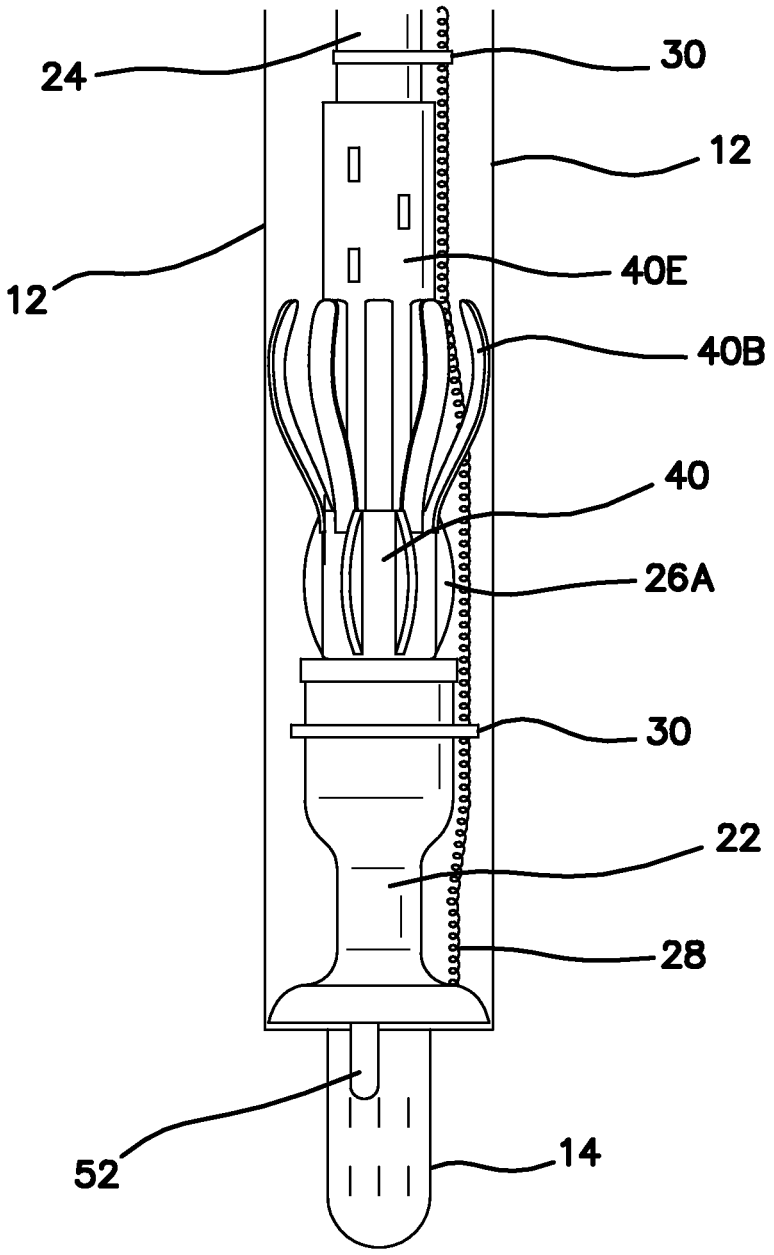
FIG. 6 a cross-section diagram of the present invention in use with components of the prior art in another configuration.
Figure 7:
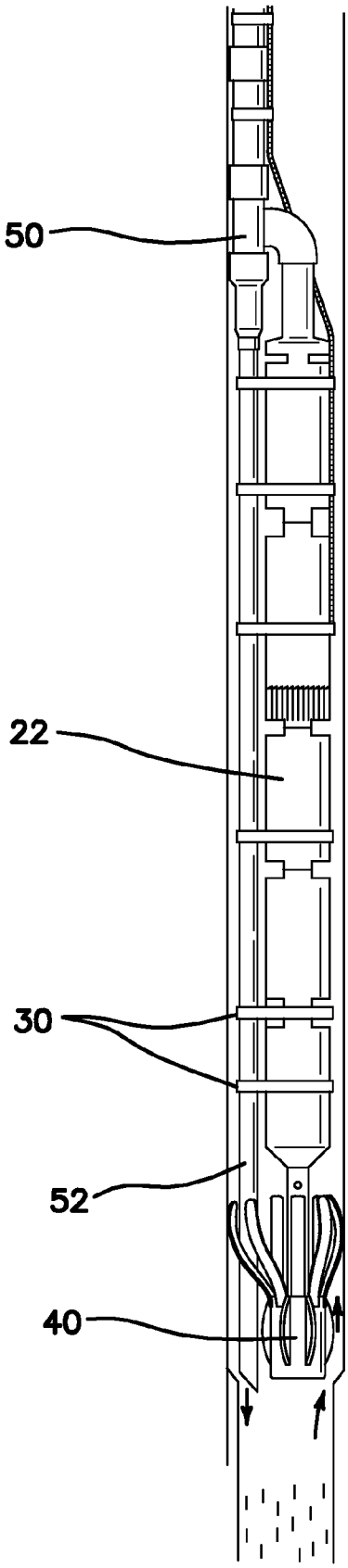
FIG. 7 a cross-section diagram of the present invention in use with components of the prior art in yet another configuration.

A solution to the above has been devised. A band basket catcher is placed above or below the submersible pump to collect or scavenge broken bands as the production tubing and pump are withdrawn from the casing. The basket catcher is made from a collar that includes a series of spring-tensioned blades arranged radially and directed upwardly that, when dragged through the casing, catches and retains any broken bands or other debris as the production tubing and pump are removed from the casing. The blades together form a basket structure to catch broken bands 30 during pump withdrawal. The band basket catcher thereby minimizes or eliminates the need for cleanout operations because it catches any broken bands as the pump itself is withdrawn.

In the preferred embodiment the basket catcher is fabricated with eight blades from a collar base of the same diameter pipe that is being used for the production tubing so that it can be affixed either to the production tubing itself or to the pump with a pup joint. Eight voids are first milled in the end of a collar at regularly spaced intervals about the collar, at forty-five degree intervals for eight blades for example. Each milled void is formed to receive an end of a blade and the individual blades are welded into each void. The blades are formed to radiate outwardly from the collar and are of sufficient length to cause the blades to contact the interior wall of a given casing. The dimensions of the blades to be formed vary depending on the internal diameter of a given casing for which the basket is intended to be used with. In all cases the blades should be sized to be long enough and radiate outwardly enough so that the outside of the blades contact the interior wall with spring tension against the surrounding casing, and further curve inwardly at the ends distal the collar. The inward curve is provided so that the ends do not catch on any collars connecting casings together.

In this manner the spring tensioning of the blades also allows the basket catcher to continue maintaining contact with he interior casing wall should the internal diameter vary by use of stands of casing of different diameter in the string of casing. As the basket catcher is moved from a casing of one internal diameter to a casing of a different internal diameter the basket catcher blades will retract or expand under their spring bias to maintain contact with the wall of the casing.

It is preferred that the basket catcher be affixed below a submersible pump, below the lowest bands and flat guards that are at risk of loss, with a length of perforated pup joint to serve the dual functions of connecting the basket catcher to the pump and of also creating a storage space to collect any broken bands and other debris collected as it is removed from the casing. A No-Go 26 created on the basket catcher can prevent the basket catcher from slipping into a liner section.

Multiple basket catchers can be used in combination with a single production tube, placing them for example above and below the pump or along the production line, as desired, to effect multiple cleanings of a casing.

A Y-Tool may be used with the basket catcher of the present invention. A Y-Tool allows a second tool to be affixed to the production tubing along with the pump. For example a Y-tool may be affixed to the end of the production tubing and the Y-Tool is also connected to both a submersible pump an instrument monitoring tube or other equipment that might need to extend further toward the liner, past the basket catcher. One or more of the eight blades can be formed or omitted to leave an opening for that instrument tube to extend through and past the basket catcher.

The method of the present invention is straightforward. One or more basket catchers are affixed to a production string or pump of the production string prior to inserting the production string into the casing. When the production string is withdrawn debris caught by the one or more basket catchers is removed and disposed of after removal.

DESCRIPTION OF THE INVENTION AND PREFERRED EMBODIMENT

A band basket catcher 40 is placed above or below the submersible pump 22 to collect or scavenge broken bands as the production tubing 24 and pump 22 is withdrawn from the casing 12. The basket catcher 40 is made from a collar 40A used as a base that is modified to include a series of spring-tensioned blades 40B arranged radially and directed upwardly that, when dragged through the casing 12 catches and retains any broken bands 30 or other debris as the production tubing 24 and pump 22 are removed from the casing. The band basket catcher 40 thereby minimizes or eliminates the need for cleanout operations because it catches any broken bands as the pump is withdrawn.

The blades 40B together form a basket structure to catch broken bands 30 during pump withdrawal. Blades 40B are used in this embodiment but such a basket could conceivably be formed from structures other than the blades of the preferred embodiment and the scope of this disclosure is intended to also encompass those equivalent structures that perform the same function.

This description, and the figures to which it refers, are provided for the purpose of describing examples and specific embodiments of the invention only and are not intended to exhaustively describe all possible examples and embodiments of the invention.

The basket catcher 40 of the presently-preferred is fabricated from a collar base 40A for use with the same diameter pipe that is being used for the production tubing 24 so that it can be affixed either to the production tubing or to the pump 22 with a pup joint 20. In the preferred embodiment the band basket catcher 40 is fabricated with eight blades 40B. Eight voids 40C are first milled in the end of a collar 40A, regularly spaced about the collar, here at forty-five degree intervals for eight blades. Each milled void 40C is formed to receive an end of a blade and the individual blades 40B are welded into each void. Eight blades 40B have been found to be sufficient to create enough of a basket to catch loose bands and other debris, while still allowing liquid to pass by the basket as it is withdrawn from the casing.

The blades 40B are formed to radiate outwardly from the collar and are of sufficient length to cause the blades to contact the interior wall of a given casing. The dimensions of the blades 40B to be formed varies depending on the internal diameter of a given casing 12, but they are typically about two inches wide and twelve inches in length, and formed to radiate away from the collar at about a forty-five degree angle. In the typical example when the band basket catcher 40 is fabricated it is about seventeen inches in overall height, initially with straight twelve-inch blades 40B, then the blades are bent inwardly at 40D, for an overall height of the blades of about nine inches. In all cases the blades 40B should be sized to be long enough and radiate outwardly enough so that the outside of the blades contact the interior wall with spring tension against the surrounding casing 12, then curve inwardly at the ends distal the collar 40A, at 40D.

The blades 40B are heat-tempered to make them flexible to maintain a spring-biased tension against the interior wall of the casing 12. This prevents broken bands from slipping past the basket catcher 40. The spring tensioning of the blades 40B also allows the basket catcher to continue maintaining contact with he interior casing 12 wall should the internal diameter vary by use of stands of casing of different diameter in the string of casing. As the basket catcher 40 is moved from a casing 12 of one internal diameter to a casing of a different internal diameter the basket catcher blades will retract or expand under their spring bias to maintain contact with the wall of the casing 12. Spring tensioning the blades 40B also makes the tool more versatile too, a single basket catcher 40 can be used with casings 12 of many different sizes. It has been found that a single basket catcher 40 having spring-tensioned blades 40B is suitable for use with 7 through 9⅝ inch interior diameter casings 12, and these dimensions include the sizes more commonly used in oil well boreholes.

The ends of the blades 40B distal the collar are formed to curve inwardly 40D so that they do not catch on the collars 16 connecting the casing 12 together; the collars may have gaps or other imperfections in the wall of the casing as the basket catcher is withdrawn from the casing. Without the slight inward curve 40D of the blades 40B the blades may function like a barb or grappling hook and potentially hold the production string in the casing.

In the preferred embodiment a No-Go 26 is formed from four semi-circular wings 26A welded to the exterior of the collar 40A of the basket catcher 40, arranged at regular intervals, here 90 degrees, to form a No-Go that will interfere with a the narrower-diameter liner 14 portion at the bottom of the bore, preventing the basket catcher from slipping into the liner.

It is preferred that the assembled basket catcher 40 made from the milled collar 40A, blades 40B and wings 40D is nickel-coated to prevent corrosion of the metal of the basket catcher, after which the basket catcher is painted.

It is preferred that the basket catcher 40 be affixed below the submersible pump 22 below the lowest bands and flat guards 30 that could be lost with a length of perforated pup joint 40E to serve the dual functions of connecting the basket catcher to the pump and of also creating a storage space to collect the broken bands and other debris as it is gathered when the string is removed from the casing 12. Broken bands 30 for example can fill the basket catcher 40 and further wrap around and stack up on the perforated pup joint 40E. Different lengths of pup joint 40E can be used to afford suitably adequate storage for a given application.

In most cases the submersible pump 22 should be attached to the production tubing 24 at its upper end and to the perforated pup joint 40E connected to the basket catcher 40 at the other lower end, so that the basket catcher resides lower in the casing 12 than the pump 22. The No-Go 26 created on the basket catcher 40 prevents the basket catcher from slipping into the liner section 14. In some applications however it is necessary to place the basket catcher above the pump 22, for example when a tool such as a de-sander or an anode needs to be hung below the pump, perhaps to extend into the liner. In this embodiment the basket catcher 40 would be attached to the pump 22 above the pump with a pup joint and the perforated pup joint length 40E would be attached to the production tubing.

Multiple basket catchers 40 can be used in combination with a single production tube 24 and pump 22, placing them for example above and below the pump or along the production line, as desired, to effect multiple cleanings of the casing 14.

In another embodiment a Y-Tool 50 may be used. A Y-Tool allows a second tool 52 to be affixed to the production tubing along with the pump 22. For example, a Y-tool 50 may be affixed to the end of the production tubing 24 and the Y-Tool is also connected to both a submersible pump 22 and, for example, an instrument monitoring tube 52 or other equipment that might need to extend further toward the liner, past the basket catcher.

In this case one or more of the eight blades 40B can be omitted to allow the tool 52 to extend through the basket catcher 50 where the blade 40B was omitted. A band basket catcher 40 of this embodiment would include only seven blades 40B, leaving an opening for that instrument tube 52 to extend through and past the basket catcher.

The method of the present invention is straightforward. One or more basket catchers 40 are affixed to a production string or pump 22 of the production string prior to inserting the production string into the casing 12. When the production string is withdrawn debris caught by the one or more basket catchers 40 is removed and disposed of. In this manner most debris can be caught by the basket catchers, reducing or eliminating the need for cleaning out the casing, as is done in the prior art.

It will be appreciated that the invention has been described hereabove with reference to certain examples or preferred embodiments as shown in the drawings. Various additions, deletions, changes and alterations may be made to the above-described embodiments and examples without departing from the intended spirit and scope of this invention. Accordingly, it is intended that all such additions, deletions, changes and alterations be included within the scope of claims allowed for this application.

What is claimed is:

1. A basket catcher for catching debris from a borehole having a casing, as production tubing is withdrawn through the casing, comprising:

a collar that includes spring-tensioned blades affixed to the collar, there is a void between two or more blades, the spring-tensioned blades of the basket catcher are arranged radially such that, when the collar is affixed to a production tube and inserted into a casing, the blades radiate outwardly towards the interior wall of the borehole casing;

the basket catcher is mounted on production tubing that includes one or more submersible pumps, electrical cable to supply power to one or more of the submersible pumps and bands to secure the electrical cable, whereby, when the basket catcher is withdrawn through the borehole casing it catches and retains debris as the production tubing is removed from the casing.

2. The basket catcher of claim 1 where the blades are formed to radiate outwardly from the collar and are of sufficient length to cause the blades to contact the interior wall of a given casing.

3. The basket catcher of claim 1 where the ends of the blades distal the collar are formed to curve inwardly so that they do not catch on a collar that connects segments of the casing.

4. The basket catcher of claim 1 further including a No-Go formed from one or more wings.

5. The basket catcher of claim 1 where the basket catcher is located above the electric submersible pump when the production tubing is inserted into the casing.

6. The basket catcher of claim 1 where the basket catcher is located below the electric submersible pump when the production tubing is inserted into the casing.

7. The basket catcher of claim 1 further including a second basket catcher, where one basket catcher is located above the electric submersible pump and the second is located below the pump.

8. The basket catcher of claim 1 where a void is created in the basket catcher to allow a Y-tool to be used with the band catcher by allowing an instrument tube to extend through the band catcher.

9. The basket catcher of claim 8 where the void for the instrument tube is created by omitting a blade of the band catcher.

10. The basket catcher of claim 1 where the blades of are formed to radiate upwardly in the borehole casing when it is inserted into the casing.

11. A method for catching debris as production tubing is withdrawn through a borehole having a casing, comprising the steps of:

providing a basket catcher having a collar that includes spring-tensioned blades affixed to the collar, the spring-tensioned blades of the basket catcher are arranged radially such that, when affixed to a production tube and inserted into a casing, they radiate outwardly towards the interior wall of the casing;

the basket catcher is mounted on production tubing that includes one or more submersible pumps, electrical cable to supply power to one or more of the submersible pumps and bands to secure the electrical cable, and withdrawing the basket catcher through the borehole.

12. The method of claim 11, where the blades are formed to radiate outwardly from the collar and are of sufficient length to cause the blades to contact the interior wall of a given casing.

13. The method of claim 11, where the ends of the blades distal the collar are formed to curve inwardly so that they do not catch on a collar that connects segments of the casing.

14. The method of claim 11, further including a No-Go formed having one or more wings.

15. The method of claim 11, where the basket catcher is located above the electric submersible pump when the production tubing is inserted into the casing.

16. The method of claim 11, where the basket catcher is located below the electric submersible pump when the production tubing is inserted into the casing.

17. The method of claim 11, further including a second basket catcher, where one basket catcher is located above the electric submersible pump and the second is located below the pump.

18. The method of claim 11, where a void is created in the blades of the basket catcher sufficient to allow a Y-tool to be used with the band catcher by allowing an instrument tube to extend past the band catcher blades.

19. The method of claim 18 where the void for the instrument tube is created by omitting a blade of the band catcher.

20. The method of claim 11, where the blades of the basket catcher are formed to radiate upwardly in the borehole casing when it is inserted into the casing.

* * * * *